US011976393B2

(12) United States Patent
Karunaratne et al.

(10) Patent No.: US 11,976,393 B2
(45) Date of Patent: May 7, 2024

(54) KNITTED STRUCTURE FOR AN ACTUATION ELEMENT

(71) Applicant: MAS Innovation (Private) Limited, Battaramulla (LK)

(72) Inventors: Angelo Karunaratne, Colombo (LK); Hetti Arachchige Malaka Chathuranga Perera, Battaramulla (LK); Dodangodage Indika Sanjeewa Wickramaratne, Battaramulla (LK); Weeramundha Sayakkara Udara Pulajith, Battaramulla (LK); Janmi Perera, Battaramulla (LK); Mihan Zain, Battaramulla (LK)

(73) Assignee: MAS Innovation (Private) Limited, Battaramulla (LK)

( * ) Notice: Subject to any disclaimer, the term of this patent is extended or adjusted under 35 U.S.C. 154(b) by 0 days.

(21) Appl. No.: 17/790,383

(22) PCT Filed: Dec. 7, 2021

(86) PCT No.: PCT/SG2021/050765

§ 371 (c)(1),
(2) Date: Jul. 7, 2022

(87) PCT Pub. No.: WO2022/146232

PCT Pub. Date: Jul. 7, 2022

(65) Prior Publication Data

US 2023/0392305 A1 Dec. 7, 2023

(30) Foreign Application Priority Data

Dec. 31, 2020 (GB) ..... 2020823

(51) Int. Cl.
*D04B 1/18* (2006.01)

(52) U.S. Cl.
CPC ..... *D04B 1/18* (2013.01); *D10B 2401/061* (2013.01); *D10B 2401/062* (2013.01); *D10B 2403/021* (2013.01); *D10B 2501/02* (2013.01)

(58) Field of Classification Search
CPC ..... D04B 1/18; D04B 1/123; D04B 1/106; D10B 2401/061; D10B 2401/062; D10B 2401/063
See application file for complete search history.

(56) References Cited

U.S. PATENT DOCUMENTS 4,750,339 A 6/1988 Simpson, Jr. et al.
8,034,007 B2 10/2011 Avitable et al.
(Continued)

FOREIGN PATENT DOCUMENTS

EP 0208332 A2 1/1987
EP 0867548 A2 9/1998
(Continued)

OTHER PUBLICATIONS

International Preliminary Report on Patentability in related application PCT/SG2021/050765 dated Jul. 13, 2023.
(Continued)

*Primary Examiner* — Danny Worrell
(74) *Attorney, Agent, or Firm* — Patterson + Sheridan, LLP

(57) ABSTRACT

The present disclosure generally relates to a knitted structure (100) for an actuation element. The knitted structure (100) comprises: an elastic fabric layer (102); an inelastic fabric layer (104), the elastic fabric layer (102) being knitted with the inelastic fabric layer (104) along their respective joint edges; and a channel (106) formed between the elastic fabric layer (102) and inelastic fabric layer (104), the channel (106) configured for receiving the actuation element, wherein upon actuation of the actuation element, the elastic fabric
(Continued)

(Section A-A)

layer (102) is stretched by the actuation element while the inelastic fabric layer (104) is undeformed.

19 Claims, 5 Drawing Sheets

(56) References Cited

U.S. PATENT DOCUMENTS

| | | | | |
|---|---|---|---|---|
| 8,800,172 | B2 * | 8/2014 | Dua | A43B 23/0275 36/55 |
| 9,150,986 | B2 | 10/2015 | Dua et al. | |
| 9,745,677 | B2 * | 8/2017 | Dua | D04B 1/123 |
| 10,359,059 | B2 | 7/2019 | Ball | |
| 10,687,634 | B1 * | 6/2020 | Kim | B60N 2/914 |
| 10,729,208 | B2 | 8/2020 | Podhajny et al. | |
| 2002/0108491 | A1 | 8/2002 | Stahn | |
| 2003/0088201 | A1 | 5/2003 | Darcey | |
| 2006/0021390 | A1 | 2/2006 | Gebel et al. | |
| 2010/0305484 | A1 | 12/2010 | Grollier et al. | |
| 2012/0255201 | A1 * | 10/2012 | Little | A43D 111/00 12/142 R |
| 2014/0323934 | A1 | 10/2014 | Bertaux-Hegemann et al. | |
| 2016/0310348 | A1 | 10/2016 | Farrow | |
| 2017/0067490 | A1 | 3/2017 | Dion et al. | |
| 2017/0152615 | A1 | 6/2017 | Jang et al. | |
| 2019/0015233 | A1 | 1/2019 | Galloway et al. | |
| 2019/0195427 | A1 * | 6/2019 | Alexander | B32B 7/12 |
| 2020/0113269 | A1 | 4/2020 | Tamm | |
| 2020/0375270 | A1 * | 12/2020 | Holschuh | B32B 5/08 |
| 2022/0331195 | A1 * | 10/2022 | Ren | A61F 5/34 |
| 2023/0032939 | A1 * | 2/2023 | Casillas | A41C 3/14 |

FOREIGN PATENT DOCUMENTS

| | | | |
|---|---|---|---|
| EP | 0691197 | B1 | 4/2004 |
| EP | 1624800 | B1 | 9/2008 |
| EP | 3043668 | A1 | 7/2016 |
| EP | 2745816 | B1 | 7/2017 |
| EP | 3433492 | A2 | 1/2019 |
| EP | 3351220 | B1 | 4/2020 |
| KR | 101737610 | B1 | 5/2017 |
| WO | 2005052235 | A1 | 6/2005 |
| WO | 2015102723 | A2 | 7/2015 |
| WO | 2016144971 | A1 | 9/2016 |
| WO | 2018129521 | A2 | 7/2018 |
| WO | 2019104263 | A1 | 5/2019 |
| WO | 2020117963 | A1 | 6/2020 |

OTHER PUBLICATIONS

Search report in related application GB 2020823.7 dated Jun. 22, 2021.

Albaugh Lea et al.: "Digital Fabrication of Soft Actualyted Objects by Machine Knitting", in CHI conference on Human Factors in Computing Systems Proceedings (CHI 2019), May 4-9, 2019, Glasgow, Scotland UK, pp. 1-13, XP058575646.

International Search Report and Written Opinion in related application PCT/SG2021/050765 dated Mar. 23, 2022.

Albaugh Lea Lea@Andrew CMU EDU et al: "Digital Fabrication of Soft Actuated Objects by Machine Knitting", Human Factors in Computing Systems, ACM, 2 Penn Plaza, Suite 701New York,NY10121-0701USA, May 2, 2019 (May 2, 2019), pp. 1-13, XP058575646, DOI: 10.1145/3290605.3300414; ISBN: 978-1-4503-5971-9 the whole document.

International Search Report and Written Opiniion in related application PCT/SG2021/050765 dated Mar. 23, 2022.

* cited by examiner (Section A-A)

(Section A-A)

KNITTED STRUCTURE FOR AN ACTUATION ELEMENT

CROSS REFERENCE TO RELATED APPLICATION(S)

The current invention claims the benefit of United Kingdom Patent Application No. 2020823.7 filed on 31 Dec. 2020, which is incorporated in its entirety by reference herein.

TECHNICAL FIELD

The present disclosure relates to a knitted structure for an actuation element and a device comprising the knitted structure.

BACKGROUND

The listing or discussion of a prior-published document in this specification should not necessarily be taken as an acknowledgement that the document is part of the state of the art or is common general knowledge.

Actuators such as fluidic actuators like inflatable bladders are used in many products, such as inflatable beds or mattresses and garments for medical purposes. For example, some garments include inflatable bladders that provide compression treatment therapy to users. United States patent publication 2019/0015233 describes fabric-based fluidic actuators made by joining two layers to form a pocket for integrating a bladder. The two layers are separately formed and joined together after integrating the bladder in the pocket. The two layers are joined together by sewing or other bonding methods. This cut and sew production process involves several operations including forming the two layers from individual fabric panels, cutting the two layers to shape from the fabric panels, and sewing the two layers together. These cut and sew operations result in more wastage of fabric material especially from the unused areas of the fabric panels. There is therefore a need to provide an improved fabric structure that would address one or more problems mentioned above.

SUMMARY

According to a first aspect of the present disclosure, there is a knitted structure for an actuation element, comprising: an elastic fabric layer; an inelastic fabric layer, the elastic fabric layer being knitted with the inelastic fabric layer along their respective joint edges; and a channel formed between the elastic fabric layer and inelastic fabric layer, the channel configured for receiving the actuation element, wherein upon actuation of the actuation element, the elastic fabric layer is stretched by the actuation element while the inelastic fabric layer is undeformed.

According to a second aspect of the present disclosure, there is a method of producing a knitted structure for an actuation element, the method comprising knitting the knitted structure in a continuous process using a knitting machine. The knitted structure comprises: an elastic fabric layer; an inelastic fabric layer, the elastic fabric layer being seamlessly knitted with the inelastic fabric layer along their respective joint edges; and a channel formed between the elastic fabric layer and inelastic fabric layer, the channel configured for receiving the actuation element, wherein upon actuation of the actuation element, the elastic fabric layer is stretched by the actuation element while the inelastic fabric layer is undeformed.

According to a third aspect of the present disclosure, there is a device comprising a set of actuation portions, each actuation portion comprising a knitted structure comprising. The knitted structure comprises: an elastic fabric layer; an inelastic fabric layer, the elastic fabric layer being knitted with the inelastic fabric layer along their respective joint edges; and a channel formed between the elastic fabric layer and inelastic fabric layer, the channel configured for receiving an actuation element, wherein upon actuation of the actuation elements, the elastic fabric layers are stretched by the actuation elements while the inelastic fabric layers are undeformed.

BRIEF DESCRIPTION OF DRAWINGS

Certain embodiments of the present disclosure are described more fully hereinafter with reference to the accompanying drawings.

DETAILED DESCRIPTION

In the present disclosure, depiction of a given element or consideration or use of a particular element number in a particular figure or a reference thereto in corresponding descriptive material can encompass the same, an equivalent, or an analogous element or element number identified in another figure or descriptive material associated therewith. The use of "I" in a figure or associated text is understood to mean "and/or" unless otherwise indicated. The recitation of a particular numerical value or value range herein is understood to include or be a recitation of an approximate numerical value or value range.

For purposes of brevity and clarity, descriptions of embodiments of the present disclosure are directed to a knitted structure for an actuation element in accordance with the drawings. While aspects of the present disclosure will be described in conjunction with the embodiments provided herein, it will be understood that they are not intended to limit the present disclosure to these embodiments. On the contrary, the present disclosure is intended to cover alternatives, modifications and equivalents to the embodiments described herein, which are included within the scope of the present disclosure as defined by the appended claims. Furthermore, in the following detailed description, specific details are set forth in order to provide a thorough understanding of the present disclosure. However, it will be recognized by an individual having ordinary skill in the art, i.e. a skilled person, that the present disclosure may be practiced without specific details, and/or with multiple details arising from combinations of aspects of particular embodiments. In a number of instances, well-known systems, methods, procedures, and components have not been described in detail so as to not unnecessarily obscure aspects of the embodiments of the present disclosure.

In embodiments herein, the word "comprising" may be interpreted as requiring the features mentioned, but not limiting the presence of other features. Alternatively, the word "comprising" may also relate to the situation where only the components/features listed are intended to be present (e.g. the word "comprising" may be replaced by the phrases "consists of" or "consists essentially of"). It is explicitly contemplated that both the broader and narrower interpretations can be applied to all aspects and embodiments of the present disclosure. In other words, the word "comprising" and synonyms thereof may be replaced by the phrase "consisting of" or the phrase "consists essentially of" or synonyms thereof and vice versa.

Figure 1:
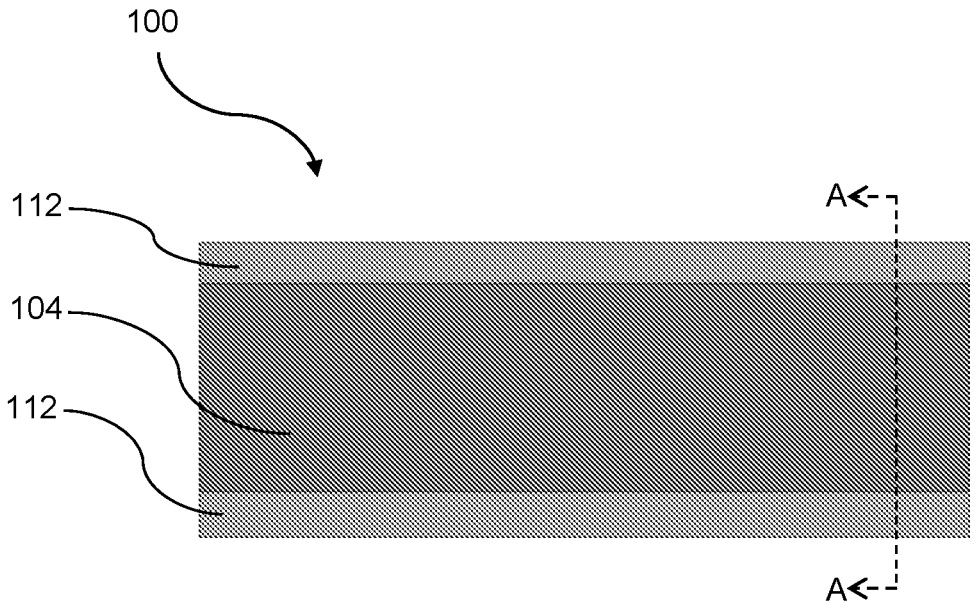
FIG. 1 is a side view illustration of a knitted structure having an elastic fabric layer and an inelastic fabric layer.
Figure 2:
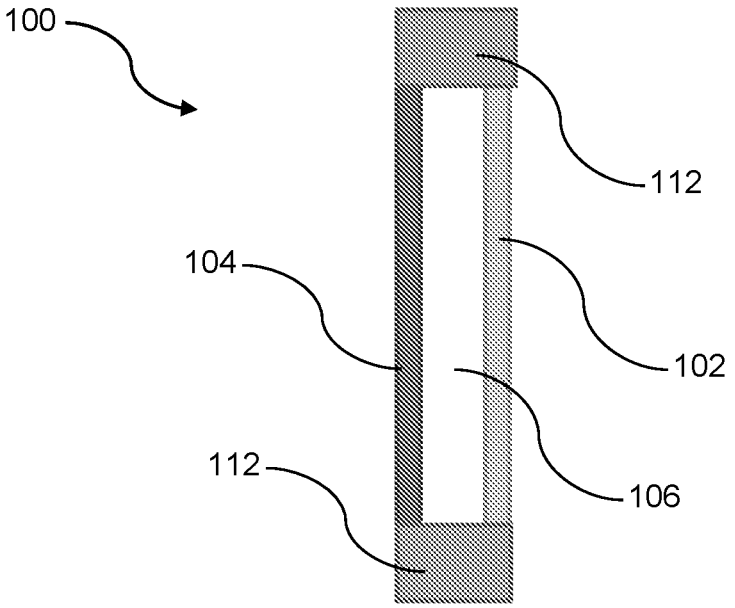
FIGS. 2 and 3 are section view illustrations of the knitted structure.

Representative or exemplary embodiments of the present disclosure describe a knitted structure 100 for an actuation element (not shown) and a method for producing the knitted structure 100. As shown in FIG. 1 and FIG. 2, the knitted structure 100 includes an elastic fabric layer 102 and an inelastic fabric layer 104. Particularly, the elastic fabric layer 102 and inelastic fabric layer 104 are arranged such that they are on opposing sides to each other. The elastic fabric layer 102 is knitted with the inelastic fabric layer 104 along their respective joint edges, i.e. edges of the elastic fabric layer 102 and inelastic fabric layer 104 that are connected and seamlessly knitted to each other.

In many embodiments, the actuation element may include a fluidic actuator such as an inflatable bladder. The inflatable bladder can be fluidically connected to a fluidic source for inflating the bladder with a fluid such as air. It will be appreciated that the actuation element may be or include other types of actuators, such as soft/fabric-based actuators, as will be readily understood by the skilled person.

The method for producing the knitted structure 100 can be performed using a knitting machine. The knitting machine is configured to knit the knitted structure 100 in a continuous process. The knitted structure 100 including the elastic fabric layer 102 and inelastic fabric layer 104 is thus knitted with a continuous and seamless knitted arrangement, wherein the elastic fabric layer 102 and inelastic fabric layer 104 are seamlessly knitted together. The knitting machine may be a flatbed knitting machine, circular knitting machine, or warp knit machine.

Preferably, the knitting machine is a V-bed flat knitting machine. As will be readily understood by the skilled person, the V-bed flat knitting machine includes components such as the front and back beds, carriage, latch needles, and yarn feeder. The yarn feeder is pulled along the beds by the carriage and feeds yarns to the latch needles for knitting. The V-bed flat knitting machine can be configured for seamless fabric knitting with minimal or no cutting and sewing processes by configuring the components of the machine accordingly. The elastic fabric layer 102 and inelastic fabric layer 104 can be seamlessly knitted together using the V-bed flat knitting machine, producing a sleeker product and saving production time and cost. Yarn consumption is minimized because there is minimal wastage from unused fabric material, thereby improving productivity and sustainability. By obviating the cutting and sewing processes, risk of defects and damages from the fabric knitting is minimized, allowing for more consistent product quality to be achieved. The V-bed flat knitting machine is capable of producing various types of seamless knitted structures, including knitted structures in flat or tubular form.

The knitted structure 100 is in a tubular form and includes a channel or tunnel 106 formed between the elastic fabric layer 102 and inelastic fabric layer 104. The channel 106 is configured for receiving and housing the actuation element such as an inflatable bladder. During actuation of the actuation element, such as by inflation of the bladder, the actuation element expands and the elastic fabric layer 102 is stretched by the actuation element while the inelastic fabric layer 104 is undeformed. As used herein, elastic means capable of returning to the initial state or form after deformation. Accordingly, when the actuation element is actuated back to its initial state, such as by deflation of the bladder, the tension in the stretched elastic fabric layer 102 will be released and the elastic fabric layer 102 will return to its initial state.

Figure 3:
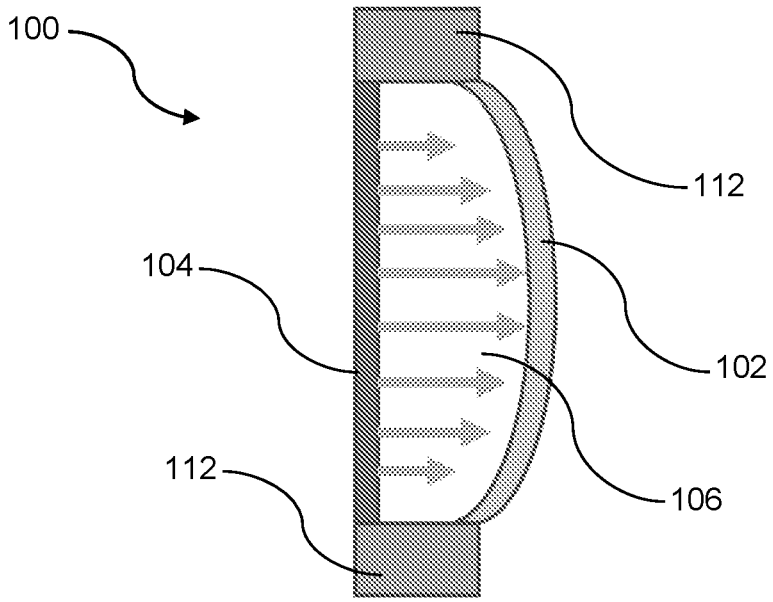

As shown in FIG. 3, the actuation of the actuation element housed in the channel 106 resiliently stretches elastic fabric layer 102. As only one side of the knitted structure 100 is elastic/stretchable, the knitted structure 100 expands unidirectionally along the stretching direction of the elastic fabric layer 102. The inelastic fabric layer 104 is undeformed, i.e. the inelastic fabric layer 104 does not stretch, during actuation or expansion of the actuation element. This rigidity of the inelastic fabric layer 104 maintains its shape and provides structural support to the knitted structure 100. It will be appreciated that the elastic fabric layer 102 and inelastic fabric layer 104 can be configured differently to achieve different shapes.

The elastic fabric layer 102 is formed by knitting with elastic yarns. For example, the elastic yarns may be formed of or include an elastic material such as, but not limited to, Spandex, Lycra, elastane, natural/synthetic rubber, or an elastic polyurethane material. For example, the elastic yarns may include a main yarn that can be formed of or include any suitable fabric/textile material such as, but not limited to, polyester, polyamide, polypropylene, cotton, viscose, lyocell, and wool. The main yarn may be covered with a suitable covering yarn formed of the elastic material such as elastane.

The inelastic fabric layer 104 is formed by knitting with inelastic yarns. For example, the inelastic yarns may be formed of or include an inelastic material such as thermoplastic polyurethane (TPU) or other polyurethane plastics. As the inelastic fabric layer 104 is designed to provide structural support, the inelastic fabric layer 104 may include stronger or stiffer inelastic yarns lining the peripheral edges or perimeter of the inelastic fabric layer 104. For example, the inelastic yarns lining the peripheral edges may include a stiffer TPU material. The inelastic yarns may be subjected to a heating process or heat treatment to stiffen the inelastic fabric layer 104.

In addition to the heat treatment process, whereby in the construction process to produce the knitted structure 100, rigid elements (e.g. metal sheets) may be inserted in the channel 106 where the actuation element (e.g. an inflatable air bladder) would sit. This prevents the elastic fabric layer 102 and inelastic fabric layer 104 joining together inside the channel 106 when the TPU material melts, allowing the knitted structure 100 to keep the distinct functionality of each fabric layer 102, 104.

Figure 4:
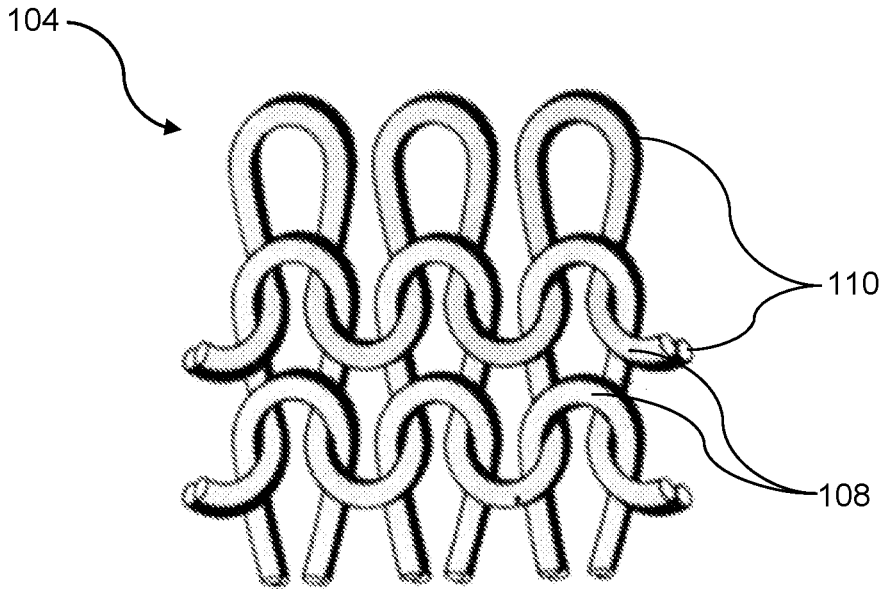
FIG. 4 is an illustration of a plated yarn structure of the inelastic fabric layer.

In some embodiments, the inelastic fabric layer 104 may have the inelastic yarns arranged in a plated yarn structure as shown in FIG. 4. The inelastic yarns may include a main yarn 108 and a plating yarn 110, and the main yarn 108 may be covered with a suitable covering yarn. The plating yarn 110 may include the inelastic material mentioned above for the inelastic fabric layer 104, such as a TPU material. The main yarn 108 can be formed of or include any suitable fabric/textile material such as, but not limited to, polyester, polyamide, polypropylene, cotton, viscose, lyocell, and wool. As will be understood by the skilled person, the plated yarn structure has the loops of the main yarn 108 and plating yarn 110 running in line with each other. The main yarn 108 forms the technical face of the plated yarn structure and the plating yarn 110, which are plated on the main yarn 108, forms the technical back of the plated yarn structure. The plated yarn structure can be produced using the V-bed flat knitting machine by feeding the main yarn 108 and plating yarn 110 through separate respective feeding holes of the yarn feeder, wherein the feeding holes are arranged such that they are fed according to a predetermined angular relationship.

In some embodiments, the main yarn 108 and plating yarn 110 are integrally formed as a single integrated yarn that is fed through a single feeding hole of the yarn feeder. In one embodiment, the main yarn 108 is plied onto the plating yarn 110 or vice versa. In another embodiment, one of the main yarn 108 and plating yarn 110 is covered with the other of the main yarn 108 and plating yarn 110. In another embodiment, a first group of fibres/filaments/threads having the properties of the main yarn 108 is combined with a second group of fibres/filaments/threads having the properties of the plating yarn 110.

In some embodiments, the elastic fabric layer 102 is knitted directly with the inelastic fabric layer 104 along their respective joint edges. In some embodiments as shown in FIG. 1 and FIG. 2, the knitted structure 100 further includes a joint fabric layer 112 disposed between the joint edges of the elastic fabric layer 102 and inelastic fabric layer 104. The joint fabric layer 112 is knitted with the elastic fabric layer 102 and inelastic fabric layer 104 along their respective joint edges, such that the elastic fabric layer 102 is knitted with the inelastic fabric layer 104 via the joint fabric layer 112, while retaining the channel 106 for insertion of the actuation element.

Figure 5:
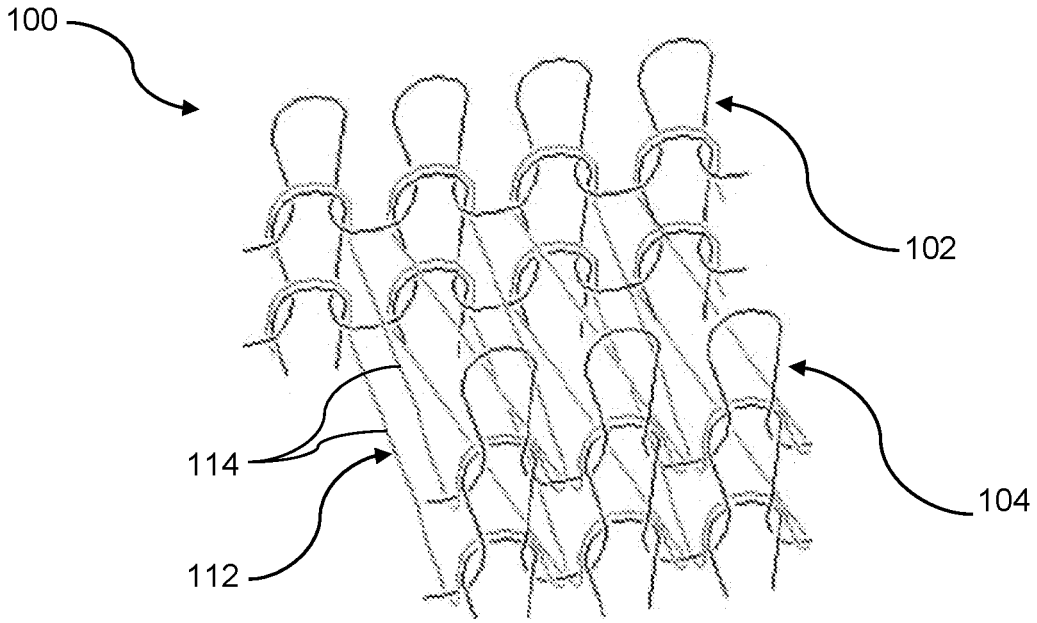
FIG. 5 is an illustration of a yarn structure of the knitted structure.

The joint fabric layer 112 may be inelastic such that it is undeformed during actuation of the actuation element to reinforce structural support to the knitted structure 100. As shown in FIG. 5, the joint fabric layer 112 may include pile yarns or spacer yarns 114 knitted between the elastic fabric layer 102 and inelastic fabric layer 104. The spacer yarns 114 may be formed of or including an inelastic material, such as TPU or other polyurethane plastics.

The addition of the joint fabric layer 112 between the elastic fabric layer 102 and inelastic fabric layer 104 expands the channel 106 and enables the knitted structure 100 to achieve a more prominent 3D profile. The knitted structure 100 may be referred to as a 3D spacer fabric structure. The 3D spacer fabric structure can be produced using the V-bed flat knitting machine. Both the elastic fabric layer 102 and inelastic fabric layer 104 are knitted separately on both front and back beds, and then connected by the joint fabric layer 112. Specifically, the spacer yarns 114 of the joint fabric layer 112 connect to the elastic fabric layer 102 and inelastic fabric layer 104 by tuck stitch knitting alternatively on both beds.

The knitted structure 100 may include one or more types of knitting within itself. In some embodiments, the knitted structure 100 includes one or more of single jersey, double jersey, interlock, pique, and rib structures within the knitted structure 100. For example, the joint fabric layer 112 may be knitted with the elastic fabric layer 102 and inelastic fabric layer 104 using the double jersey or interlock structure. For example, the elastic fabric layer 102 and inelastic fabric layer 104 on both sides of the channel 106 may be knitted using the single jersey or pique structure. It will be appreciated that the knitted structure 100 may not be limited to the types of knits mentioned above.

The knitted structure 100 is thus configured to house the actuation element in the channel 106 to support actuation of the actuation element. For example, the elastic fabric layer 102 is knitted to the inelastic fabric layer 104 along their longer joint edges, and the actuation element is inserted into the channel 106 via the shorter edges. The shorter edges are then joined together, such as by further knitting, sewing, or bonding, etc., to hold the actuation element in the channel 106.

When the actuation element is actuated, the inelastic fabric layer 104 is undeformed or is relatively rigid and directs the actuation and expansion of the actuation element to the elastic fabric layer 102. The actuation pressure and energy from the actuation element is restrained by the inelastic fabric layer 104 and transferred to the elastic fabric layer 102 and the elastic fabric layer 102 will be stretched unidirectionally. The unidirectional stretching allows the knitted structure 100 to be used for targeted application of the actuation pressure, such as for targeted compression on a user's body. It will be appreciated that the knitted structure 100 can be configured, such as by arranging the elastic fabric layer 102 and inelastic fabric layer 104 as appropriate, to achieve a desired stretching direction.

Various devices or products can be produced using the knitted structure 100 according to any embodiment described above. The knitted structure 100 can be incorporated in a device such as a garment or fabric product. The device includes a set of one or more actuation portions, each actuation portion having the knitted structure 100. The actuation portions may be formed in the device using various attachment or bonding means. For example, the actuation portions may be sewed or stitched to each other to form an arrangement of the channels 106 for housing a corresponding number of actuation elements. The physically separated actuation elements in the device provide higher resolution for targeted actuation. Various types of devices can be produced, and customized production of these devices can be achieved through computerized systems that control the knitting machine. For example, the device can be customized to different sizing options, number and arrangement of the actuation portions, and aesthetics such as brand logos, names, and design appearances.

Figure 6:
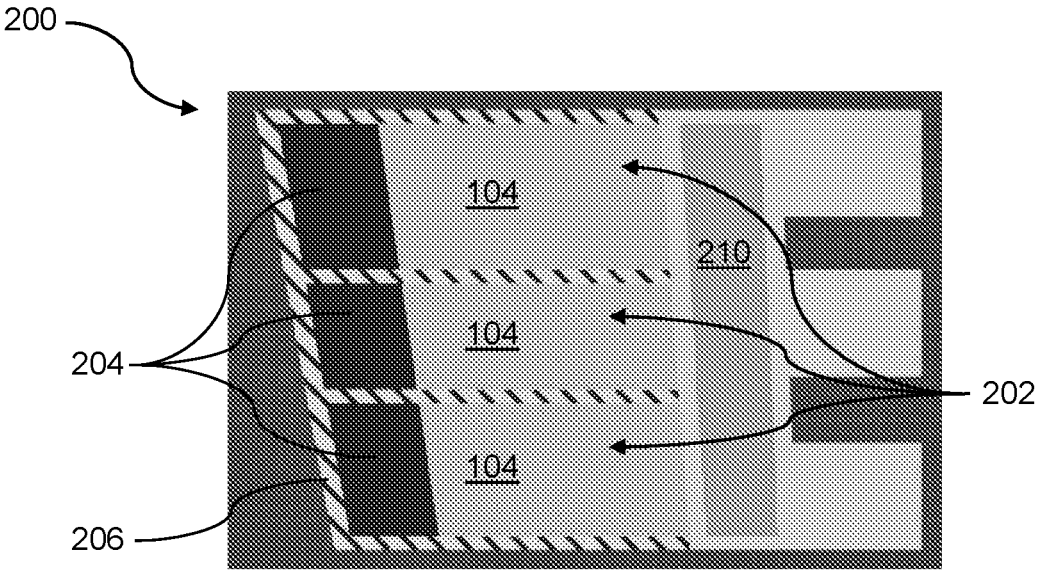
FIGS. 6 and 7 are side view illustrations of a device comprising the knitted structure.
Figure 7:
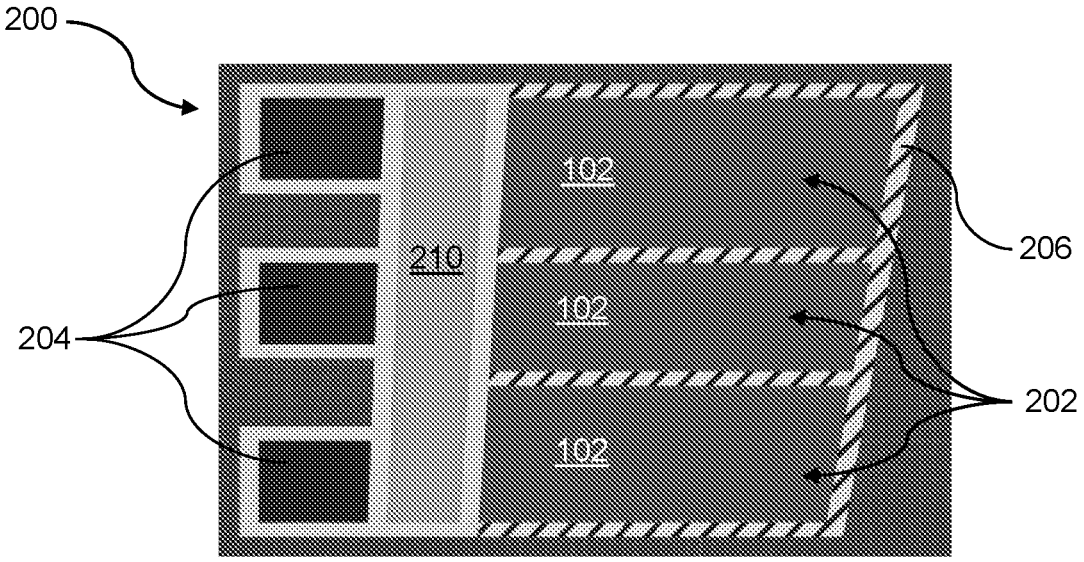

In some embodiments, the device is a garment wearable by the user, such as a compression garment. For example, as shown in FIG. 6 and FIG. 7, the compression garment is a compression sleeve 200. The compression sleeve 200 includes a number of actuation portions 202, each actuation portion 202 having the knitted structure 100 that includes the elastic fabric layer 102, inelastic fabric layer 104, and channel 106 for housing a respective actuation element. The compression sleeve 200 further includes a set of fastening elements 204 on the side of the elastic fabric layers 102 and on the side of the inelastic fabric layers 104. Some non-limiting examples of the fastening elements 204 include touch fasteners, hook-and-loop fasteners, snap buttons, clips, cable ties, etc. The fastening elements 204 can be fastened to each other such that the elastic fabric layers 102 are on the inside of the compression sleeve 200 and the inelastic fabric layers 104 are on the outside. This allows for targeted compression inwards by the elastic fabric layers 102 when the actuation elements are actuated and expanded.

As described above, the inelastic fabric layer 104 may include stronger or stiffer inelastic yarns lining the peripheral edges of the elastic fabric layer 102 and inelastic fabric layer 104. As shown in FIG. 6 and FIG. 7, the compression sleeve 200 may include an inelastic lining 206 around each actuation portion 202 that separates the actuation portions 202 from each other. The inelastic lining 206 is knitted within the knitted structure 100, such that it is seamlessly knitted with the elastic fabric layer 102 and inelastic fabric layer 104. The inelastic lining 206 may include stiffer inelastic yarns that may be made of a stiffer TPU material.

Figure 8:
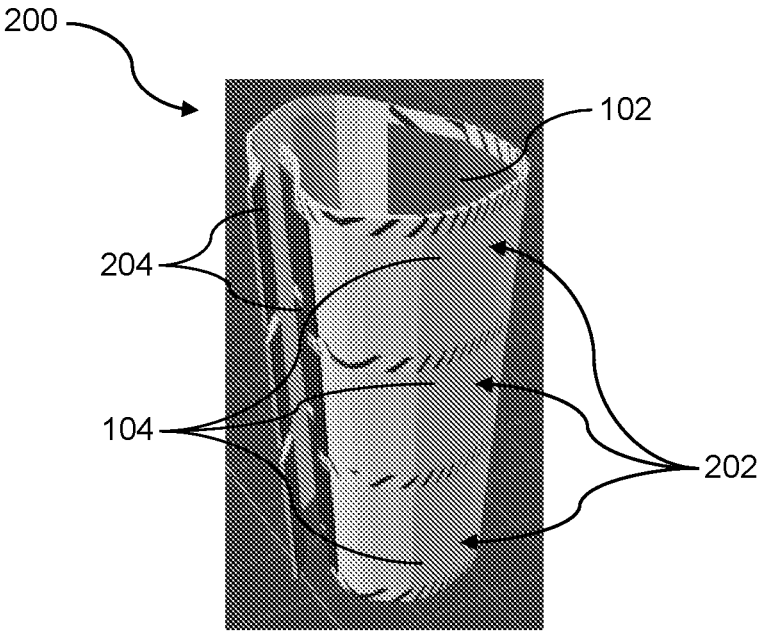
FIGS. 8 and 9 are illustrations of the device worn on a limb.
Figure 9:
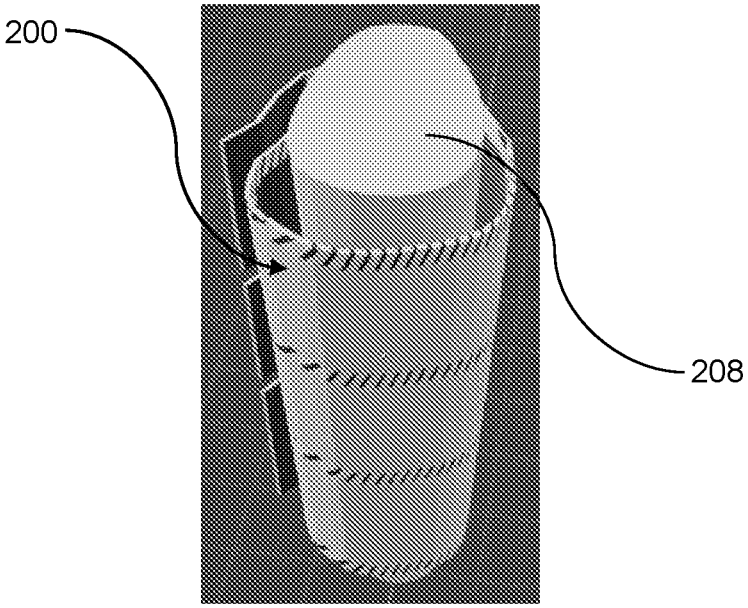

The compression sleeve 200 including the actuation elements, such as inflatable bladders, housed in the respective channels 106 can be worn on any part of the user's body, such as the chest, pelvis, or limbs. For example, as shown in FIG. 8 and FIG. 9, the compression sleeve 200 is worn on a limb 208, such as an arm or a leg or a portion thereof, of the user. The fastening elements 204 are fastened together to fasten and secure the compression sleeve 200 to the limb 208. The compression sleeve 200 is arranged on the limb 208 such that the elastic fabric layers 102 are in contact with the limb 208. The elastic fabric layers 102 are arranged in the compression sleeve 200 such that when the compression sleeve 200 is worn and used, actuation of the actuation elements will cause the elastic fabric layers 102 to stretch and extend unidirectionally and apply targeted compression at predefined or specific areas of the limb 208 corresponding to the actuation portions 202. The physically separated actuation portions 202 provide for better body conformity of the compression sleeve 200 to the limb 208.

The compression sleeve 200 may further include a control module 210 for controlling actuation of the actuation elements, such as by controlling inflation and deflation of the inflatable bladders. For example, one or more of the actuation elements can be selectively activated to provide targeted compression at one or more different areas of the limb 208 corresponding to the respective actuation portions 202.

The compression sleeve 200 can be worn like a compression bandage for providing compression treatment therapy to the users. For example, targeted compression on the leg can promote faster healing and recovery for users suffering from venous leg ulcers. The device can be in the form of other types of garments suitable for the medical industry. For example, the device can be a compression garment used at various parts of the body, such as but not limited to the neck, shoulder, chest, back, abdominal, genital, or buttocks region.

The device can be used in other industries such as automobile, aviation, and travel industries. The device can be air bags that are unidirectionally inflatable, inflatable seats, inflatable travel wellness devices (e.g. pillows), or other customized devices. The device can also be used for apparels and upholstery products, such as inflatable beds/mattresses, chairs, sofas, as well as inflatable swimwear/life buoys that work as emergency equipment for water health and safety.

In the foregoing detailed description, embodiments of the present disclosure in relation to a knitted structure for an actuation element are described with reference to the provided figures. The description of the various embodiments herein is not intended to call out or be limited only to specific or particular representations of the present disclosure, but merely to illustrate non-limiting examples of the present disclosure. The present disclosure serves to address at least one of the mentioned problems and issues associated with the prior art. Although only some embodiments of the present disclosure are disclosed herein, it will be apparent to a person having ordinary skill in the art in view of the present disclosure that a variety of changes and/or modifications can be made to the disclosed embodiments without departing from the scope of the present disclosure. Therefore, the scope of the present disclosure as well as the scope of the following claims is not limited to embodiments described herein.

The invention claimed is:

1. A knitted structure for an actuation element, comprising:

an elastic fabric layer;

an inelastic fabric layer, the elastic fabric layer and inelastic fabric layer each having edges, the edges of the elastic fabric layer and the edges of the inelastic fabric layer being knitted to each other; and a channel formed between the elastic fabric layer and inelastic fabric layer, the channel configured for receiving the actuation element, wherein the elastic fabric layer is configured to be stretched by the actuation element upon actuation while the inelastic fabric layer is configured to be undeformed by the actuation element upon actuation.

2. The knitted structure according to claim 1, wherein the elastic fabric layer comprises elastic yarns comprising an elastic material.

3. The knitted structure according to claim 1, wherein the inelastic fabric layer comprises inelastic yarns comprising an inelastic material.

4. The knitted structure according to claim 3, wherein the inelastic fabric layer comprises stiffer inelastic yarns lining the edges of the inelastic fabric layer.

5. The knitted structure according to claim 1, wherein the inelastic fabric layer comprises a plated yarn structure comprising a main yarn and a plating yarn.

6. The knitted structure according to claim 1, wherein the elastic fabric layer comprises a main yarn and a covering yarn.

7. The knitted structure according to claim 6, further comprising a joint fabric layer, wherein the elastic fabric layer and inelastic fabric layer are knitted to each other via the joint fabric layer.

8. The knitted structure according to claim 7, wherein the joint fabric layer comprises spacer yarns.

9. A method of producing a knitted structure for an actuation element, the method comprising:

knitting the knitted structure in a continuous process using a knitting machine, the knitted structure comprising:

an elastic fabric layer;

an inelastic fabric layer, the elastic fabric layer and inelastic fabric layer each having edges, the edges of the elastic fabric layer and the edges of the inelastic fabric layer being knitted to each other; and a channel formed between the elastic fabric layer and inelastic fabric layer, the channel configured for receiving the actuation element, wherein the elastic fabric layer is configured to be stretched by the actuation element upon actuation while the inelastic fabric layer is configured to be undeformed by the actuation element upon actuation.

10. The method according to claim 9, wherein the knitting machine is a V-bed flat knitting machine.

11. The method according to claim 9, wherein the actuation element comprises an inflatable bladder.

12. A device comprising:

a set of actuation portions, each actuation portion comprising a knitted structure according to claim 1 and an actuation element housed within the channel of the knitted structure.

13. The device according to claim 12, wherein the device comprises an inelastic lining around each actuation portion that separates the actuation portions from each other.

14. The device according to claim 12, wherein the device comprises a control module for controlling actuation of the actuation elements.

15. The device according to claim 12, wherein the device is a compression garment wearable by a user.

16. The device according to claim 15, wherein the compression garment comprises a set of fastening elements for fastening the compression garment to a body part of the user.

17. The device according to claim 15, wherein upon actuation of the actuation elements, the compression garment applies targeted compression at predefined areas of the body part.

18. The device according to claim 15, wherein the compression garment is a compression sleeve.

19. The device according to claim 12, wherein the actuation element comprises an inflatable bladder.

* * * * *